US009721517B2

(12) United States Patent
Namkung et al.

(10) Patent No.: US 9,721,517 B2
(45) Date of Patent: Aug. 1, 2017

(54) DISPLAY DEVICE

(71) Applicant: Samsung Display Co., Ltd., Yongin, Gyeonggi-Do (KR)

(72) Inventors: Hyunkyu Namkung, Cheonan-si (KR); Seokyun Son, Yongin-si (KR); Jai-Hyun Koh, Hwaseong-si (KR); Heendol Kim, Yongin-si (KR); Kuk-Hwan Ahn, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/848,113

(22) Filed: Sep. 8, 2015

(65) Prior Publication Data

US 2016/0171944 A1 Jun. 16, 2016

(30) Foreign Application Priority Data

Dec. 12, 2014 (KR) ..... 10-2014-0179587

(51) Int. Cl.
*G09G 3/20* (2006.01)
*G09G 3/36* (2006.01)

(52) U.S. Cl.
CPC ..... *G09G 3/3614* (2013.01); *G09G 3/3648* (2013.01); *G09G 2300/0452* (2013.01)

(58) Field of Classification Search
CPC ..... G09G 3/20; G09G 3/2003; G09G 3/2055; G09G 3/2077; G09G 3/2051; G09G 2310/0213; G09G 2320/0285; G09G 3/2074; G09G 2310/06; G09G 2310/067; G09G 10/068; G09G 2310/0254; G09G 2310/0256; G09G 3/3614; G09G 2300/0823; G09G 2310/068; G09G 3/2942; G09G 3/296; G09G 3/2965; G09G 2310/0243; G09G 2310/0245; G09G 2310/0248; G09G 2310/0251; G09G 2310/0259; G09G 2310/0262
See application file for complete search history.

(56) References Cited

U.S. PATENT DOCUMENTS 6,469,684 B1 * 10/2002 Cole ..... G09G 3/3614 345/58
8,587,504 B2 11/2013 Joo
2008/0278466 A1 * 11/2008 Joo ..... G09G 3/3614 345/205

(Continued)

FOREIGN PATENT DOCUMENTS

KR 10-2013-0028595 3/2013
KR 10-1286514 7/2013

(Continued)

*Primary Examiner* — Lun-Yi Lao
*Assistant Examiner* — Jarurat Suteerawongsa
(74) *Attorney, Agent, or Firm* — Innovation Counsel LLP

(57) ABSTRACT

A display device according to the present disclosure includes a plurality of gate lines extending in a row direction, a plurality of data lines intersecting with the gate lines, the data lines extending in a column direction, a plurality of pixels connected to the gate lines and the data lines, and a data driving unit configured to output a plurality of data voltages to the pixels, wherein the data driving unit outputs the data voltages based on a first column inversion scheme and a second column inversion scheme to respective data lines along the column direction.

14 Claims, 5 Drawing Sheets

(56) References Cited

U.S. PATENT DOCUMENTS

| | | | | |
|---|---|---|---|---|
| 2012/0200553 | A1* | 8/2012 | Wu | G09G 3/3614 345/211 |
| 2012/0299972 | A1* | 11/2012 | Bae | G09G 3/3614 345/690 |
| 2013/0135267 | A1* | 5/2013 | Jeong | G09G 5/00 345/204 |
| 2015/0170590 | A1 | 6/2015 | Ahn et al. | |

FOREIGN PATENT DOCUMENTS

| | | |
|---|---|---|
| KR | 10-1427591 | 8/2014 |
| KR | 10-2015-0069411 | 6/2015 |

* cited by examiner

FIG. 5

| | | | | | | | |
|---|---|---|---|---|---|---|---|
| − | − | + | − | + | + | − | + |
| − | − | + | − | + | + | − | + |
| + | + | − | + | − | − | + | − |
| + | + | − | + | − | − | + | − |
| − | − | + | − | + | + | − | + |
| − | − | + | − | + | + | − | + |
| − | − | + | − | + | + | − | + |
| + | + | − | + | − | − | + | − |
| + | + | − | + | − | − | + | − |
| + | + | − | + | − | − | + | − |

< FK+1 >

DISPLAY DEVICE

CROSS-REFERENCE TO RELATED APPLICATIONS

This U.S. non-provisional patent application claims priority under 35 U.S.C. §119 of Korean Patent Application No. 10-2014-0179587, filed on Dec. 12, 2014, the entire contents of which are hereby incorporated by reference.

BACKGROUND

The present disclosure herein relates to a display device, and more particularly, to a driving scheme of a data voltage provided to a display panel.

A display device includes a display panel for displaying an image and a gate driving unit and a data driving unit for driving the display panel. The display panel includes a plurality of gate lines, a plurality of data lines, and a plurality of pixels connected to the gate lines and the data lines. The gate lines receive gate signals from a gate driving unit. The data lines receive data voltages from a data driving unit. The pixels are provided with the data voltages through the data lines in response to the gate signals received through the gate lines. The pixels present gray scales corresponding to the data voltages to thereby display an image.

If the same voltage is continuously applied between a pixel electrode and a common electrode of a display device, degradation of liquid crystals may cause a crosstalk on a screen. In order to prevent the crosstalk, a data voltage may be phase-inverted to be provided to a display panel. A scheme for driving a display panel is classified into a line inversion scheme, a column inversion scheme, a dot inversion scheme, and a quad inversion scheme according to a phase of a data voltage applied to a data line.

SUMMARY

The present disclosure provides a display device having a quad-type pixel structure.

Embodiments of the inventive concept provide display devices including a plurality of gate lines extending in a row direction, a plurality of data lines intersecting with the gate lines, the data lines extending in a column direction, a plurality of pixels connected to the gate lines and the data lines, and a data driving unit configured to output a plurality of data voltages to the pixels, wherein the data driving unit outputs the data voltages based on a first column inversion scheme and a second column inversion scheme to respective data lines along the column direction.

In some embodiments, the pixels may include a plurality of first pixels and a plurality of second pixels. Each of the first pixels may comprise a red sub-pixels and a green sub-pixel and each of the second pixels may comprise a blue sub-pixel and a white sub-pixel.

In other embodiments, the first pixels and the second pixels may be alternatingly arranged along the row direction. The first pixels and the second pixels may be alternatingly arranged in two columns along the column direction.

In still other embodiments, the pixels connected to a same gate line may have a quad inversion scheme which inverts polarities of pixels every four pixels.

In even other embodiments, the quad inversion scheme may have a first polarity pattern and a second polarity pattern, the first polarity pattern having polarities of (+), (+), (−) and (+), the second polarity pattern being an inverse pattern to the first polarity pattern.

In yet other embodiments, the first column inversion scheme may be implemented with a k-dot inversion scheme, and the second column inversion scheme may be implemented with an r-dot inversion scheme, wherein k and r are natural numbers, and k is greater than r.

In further embodiments, r may be greater than 2.

In still further embodiments, the display device may further include a polarity conversion unit configured to output an inversion driving signal for controlling polarities of the data voltages.

In even further embodiments, the data driving unit may output the data voltages in response to the inversion driving signal.

In yet further embodiments, the polarity conversion unit may output the inversion driving signal corresponding to each of a plurality of frames.

In much further embodiments, the plurality of frames may include a first frame and a second frame following the first frame, wherein the polarity conversion unit may output, to the second frame, the inversion driving signal including the polarities of the data voltages which are inverted compared to the polarities of the data voltages of the first frame.

In still much further embodiments, the first column inversion scheme may have a first column polarity pattern and a second column polarity pattern, and the second column inversion scheme may have a third column polarity pattern and a fourth column polarity pattern.

In even much further embodiments, the first column polarity pattern may have polarities of (+), (+), (−) and (−), and the second column polarity pattern may be an inverse pattern to the first column polarity pattern.

In yet much further embodiments, the third column polarity pattern may have polarities of (+), (+), (+), (−), (−) and (−), and the fourth column polarity pattern may be an inverse pattern to the third column polarity pattern.

In yet even much further embodiments, the data voltages having one of a first pattern in which the first column polarity pattern and the third column polarity pattern are repeated and a second pattern in which the second column polarity pattern and the fourth column polarity pattern are repeated may be output to the data lines along the column direction.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIGS. 4 and 5 are diagrams illustrating polarities of data voltages provided to the display panel according to an embodiment of the inventive concept.

DETAILED DESCRIPTION OF THE EMBODIMENTS

Figure 1:
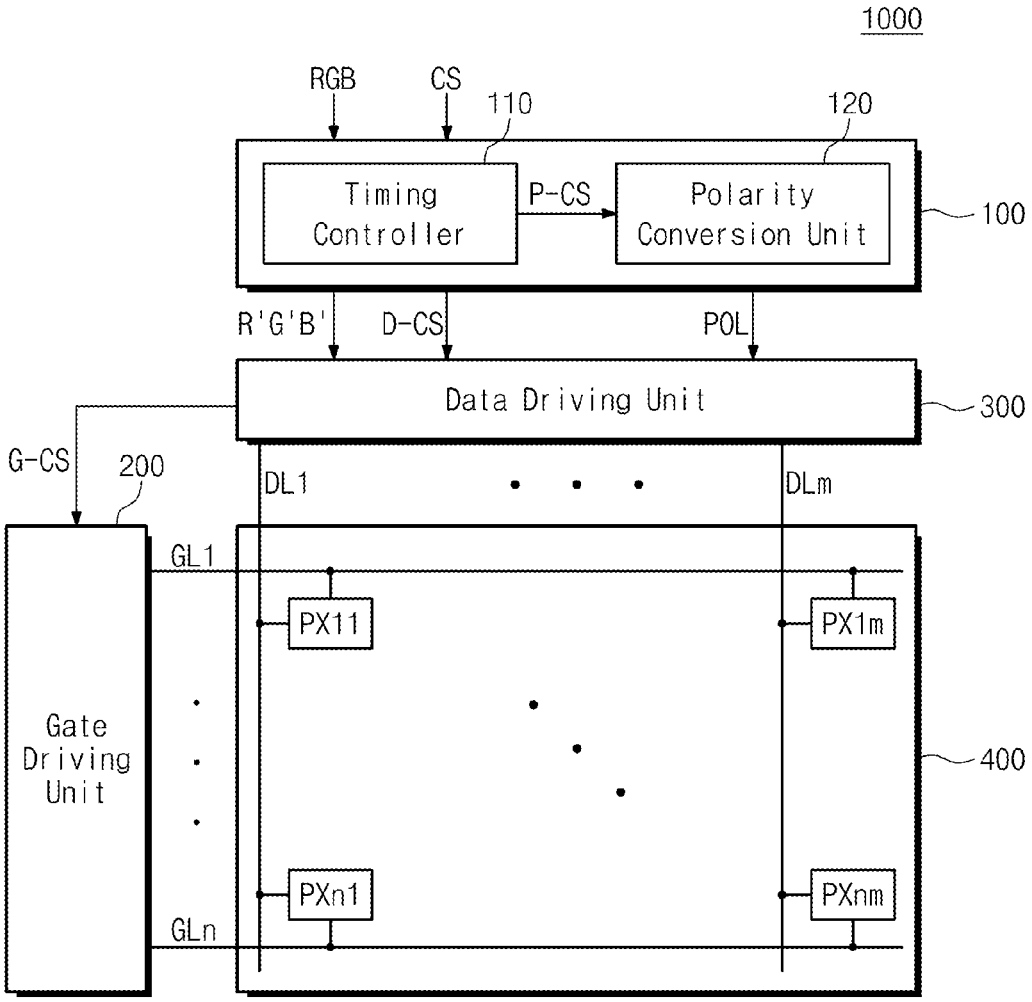
FIG. 1 is a block diagram illustrating a display device according to an embodiment of the inventive concept.

The present disclosure may be variously modified and may include various embodiments. However, particular embodiments are exemplarily illustrated in the drawings and will be described in detail. However, it should be understood that the present disclosure is not limited to specific forms, but rather cover all modifications, equivalents or alternatives that fall within the spirit and scope of the present disclosure.

Like reference numerals refer to like elements throughout the description of the drawings. In the drawings, the dimensions of structures are exaggerated or reduced for clarity of illustration. The terms "first", "second" and the like may be used for describing various elements, but the elements should not be construed as being limited by the terms. Such terms are used solely for distinguishing one element from other elements. For example, without departing the scope of the present disclosure, a first element may be referred to as a second element and vice versa. The terms of a singular form may include plural forms unless otherwise specified.

It should be further understood that the term "comprise", "comprising,", "include", "including", "have" or "having", when used herein, specifies the presence of stated features, numbers, steps, operations, elements, components or combinations thereof, but does not preclude the presence or addition of one or more other features, numbers, steps, operations, elements, components or combinations thereof.

FIG. 1 is a block diagram illustrating a display device according to an embodiment of the inventive concept.

Referring to FIG. 1, a display device 1000 includes a printed circuit board 100, a gate driving unit 200, a data driving unit 300, and a display panel 400.

The printed circuit board 100 is electrically connected to the data driving unit 300 and controls overall operation of the display device 1000. In detail, the printed circuit board 100 includes a timing controller 110 and a polarity conversion unit 120.

The timing controller 110 receives a plurality of image signals RGB and a plurality of control signals CS from the outside. The timing controller 110 converts a data format of the image signals RGB so that the image signals are compatible with an interface with the data driving unit 300. The timing controller 110 provides data-format-converted image signals R'G'B' to the data driving unit 300.

Furthermore, the timing controller 110 generates a data control signal D-CS, a gate control signal G-CS, and a polarity control signal P-CS in response to the control signals CS. For example, the data control signal D-CS may include an output initiation signal and a horizontal initiation signal. The gate control signal G-CS may include a vertical initiation signal and a vertical clock bar signal. The polarity control signal P-CS may control polarities of data voltages provided from the data driving unit 300 to the display panel 400.

The timing controller 110 provides the data control signal D-CS to the data driving unit 300, the gate control signal G-CS to the gate driving unit 200, and the polarity control signal P-CS to the polarity conversion unit 120 respectively.

The polarity conversion unit 120 receives the polarity control signal P-CS from the timing controller 110. The polarity conversion unit 120 may generate an inversion driving signal POL for controlling the polarities of the data voltages provided to the display panel 400 in response to the polarity control signal P-CS. That is, the polarities of the data voltages output from the data driving unit 300 may be changed according to the inversion driving signal POL.

According to an embodiment of the inventive concept, the polarity conversion unit 120 may generate the inversion driving signal POL for determining the polarity of a data voltage for pixels connected to each gate line on the basis of a quad inversion scheme. Furthermore, according to an embodiment of the inventive concept, the polarity conversion unit 120 may generate the inversion driving signal POL for determining the polarity of a data voltage for pixels connected to each data line on the basis of a 2-dot or 3-dot inversion scheme. The polarity conversion unit 120 transfers the inversion driving signal POL to the data driving unit 300 as described above. Operation of the polarity conversion unit 120 will be described in detail with reference to FIGS. 4 and 5.

Additionally, the polarity conversion unit 120 may generate the inversion driving signal POL for determining the polarity of a data voltage for pixels connected to each gate line on the basis of a variety of line inversion schemes.

The gate driving unit 200 outputs a plurality of gate signals in response to the gate control signal G-CS output from the timing controller 110. The gate driving unit 200 is electrically connected to a plurality of gate lines GL1 to GLn arranged in the display panel 400, and sequentially outputs the gate signals to the gate lines GL1 to GLn. Furthermore, the gate driving unit 200 may receive the gate control signal G-CS required for a driving operation directly from the timing controller 110 or via the data driving unit 300.

The data driving unit 300 receives the data control signal D-CS from the timing controller 110, and receives the inversion driving signal POL from the polarity conversion unit 120. The data driving unit 300 converts the data-format-converted image signals R'G'B' into a plurality of data voltages in response to the data control signal D-CS. The data driving unit 300 provides the data voltages to the display panel 400 in response to the inversion driving signal POL.

The display panel 400 includes the plurality of gate lines GL1 to GLn, a plurality of data lines DL1 to DLm, and a plurality of pixels PX11 to PXnm. The gate lines GL1 to GLn extend in a row direction and intersect with the data lines DL1 to DLm extending in a column direction. The gate lines GL1 to GLn are electrically connected to the gate driving unit 200 to receive the gate signals. The data lines DL1 to DLm are electrically connected to the data driving unit 300 to receive the data voltages. The pixels PX11 to PXnm are connected to corresponding gate lines and corresponding data lines. The pixels PX11 to PXnm may be sequentially scanned on a row-by-row basis by the gate signals.

According to an embodiment of the inventive concept, a pixel array of the display panel 400 may be formed by quad-type-based pixels PX11 to PXnm. In detail, the quad-type-based pixels PX11 to PXnm may include a plurality of red pixels, a plurality of green pixels, a plurality of blue pixels, and a plurality of white pixels.

Figure 2:
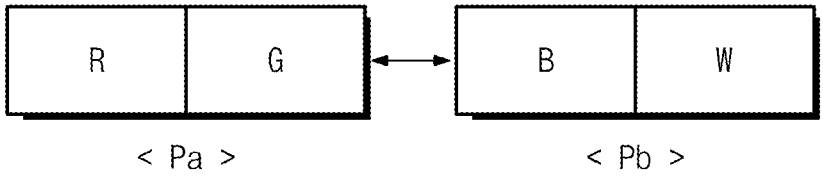
FIG. 2 illustrates a combination structure of pixels according to an embodiment of the inventive concept.
Figure 3:
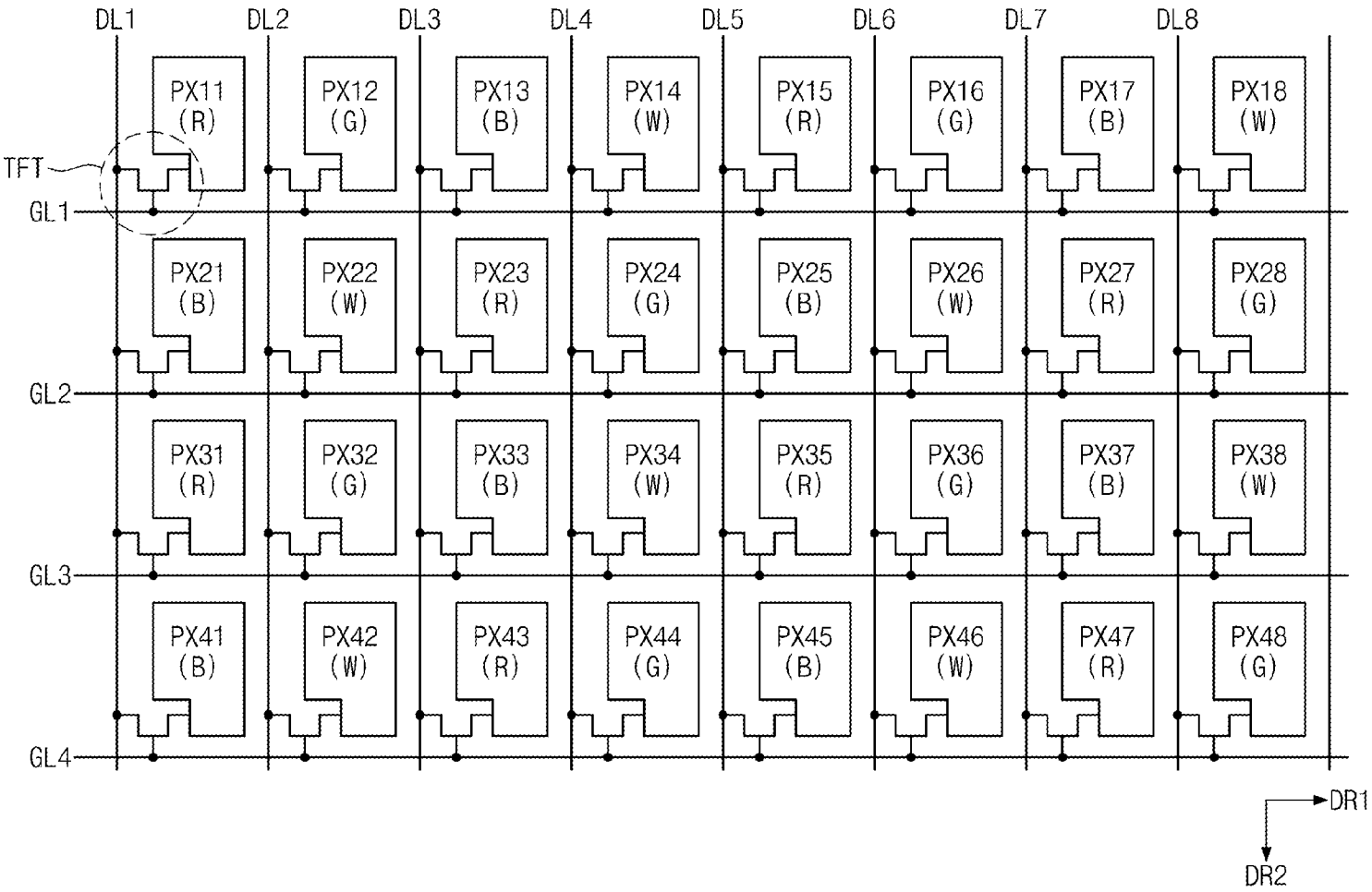
FIG. 3 is a circuit diagram illustrating the pixels arranged in a display panel on the basis of the combination structure of the pixels illustrated in FIG. 2.

FIG. 2 illustrates a combination structure of pixels according to an embodiment of the inventive concept. FIG. 3 is a circuit diagram illustrating the pixels arranged in a display panel on the basis of the combination structure of the pixels illustrated in FIG. 2.

Referring to FIG. 2, the pixels PX11 to PXnm may be arranged in the display panel 400 on the basis of a configuration of first and second pixels Pa and Pb. The first pixel Pa includes a red sub-pixel R and a green sub-pixel G. The second pixel Pb includes a blue sub-pixel B and a white sub-pixel W. Each of the pixels PX11 to PXnm may include a corresponding sub-pixel among the red sub-pixel R, the green sub-pixel G, the blue sub-pixel B, and the white sub-pixel W.

For convenience, FIG. 3 illustrates the pixels PX11 to PX48 arranged in four rows of a first direction DR1 and eight columns of a second direction DR2. However, the inventive concept is not limited thereto, and more pixels may be arranged in the display panel 400 (see FIG. 1). That is, a plurality of first pixels Pa including the red sub-pixel R and the green sub-pixel G and a plurality of second pixels Pb including the blue sub-pixel B and the white sub-pixel W may be arranged in the display panel 400.

Referring to FIG. 3, the pixels PX11 to PX48 may be electrically connected to the corresponding gate lines GL1 to GL4 row-by-row. For example, the pixels PX11 to PX18 of a first row may be sequentially connected to the first gate line GL1 along the first direction DR1. The pixels PX21 to PX28 of a second row may be sequentially connected to the second gate line GL2 along the first direction DR1. The pixels PX31 to PX38 of a third row may be sequentially connected to the third gate line GL3 along the first direction DR1. The pixels PX41 to PX48 of a fourth row may be sequentially connected to the fourth gate line GL4 along the first direction DR1.

Furthermore, the pixels PX11 to PX48 may be electrically connected to the corresponding data lines DL1 to DL8 column-by-column. For example, the pixels PX11 to PX41 of a first column may be sequentially connected to the first data line DL1 along the second direction DR2. Likewise, the pixels of second to eighth columns may be connected to corresponding data lines along the second direction DR2.

Furthermore, each pixel may be electrically connected to a corresponding gate line and a corresponding data line via a thin film transistor (TFT). The gate line is electrically connected to a gate terminal of the TFT, and the data line is electrically connected to a drain terminal of the TFT. Each pixel is electrically connected to a source terminal of the TFT. The TFT may transfer, to each pixel, a data voltage provided from a data line, in response to a gate signal provided through a gate line.

According to an embodiment of the inventive concept, the pixels PX11 to PX18 electrically connected to the first gate line GL1 are arranged along the first direction DR1 in the order of the red sub-pixel R, the green sub-pixel G, the blue sub-pixel B, and the white sub-pixel W. That is, the first pixel Pa including the red and green sub-pixels R and G and the second pixel Pb including the blue and white sub-pixels B and W may be repeatedly connected to the first gate line GL1 along the first direction DR1.

According to an embodiment of the inventive concept, the pixels PX21 to PX28 electrically connected to the second gate line GL2 are arranged along the first direction DR1 in the order of the blue sub-pixel B, the white sub-pixel W, the red sub-pixel R, and the green sub-pixel G. That is, the second pixel Pb including the blue and white sub-pixels B and W and the first pixel Pa including the red and green sub-pixels R and G may be sequentially connected to the second gate line GL2 along the first direction DR1.

The pixels PX31 to PX38 connected to the third gate line GL3 may be arranged in the same manner as the pixels PX11 to PX18 connected to the first gate line GL1. Likewise, the pixels PX41 to PX48 connected to the fourth gate line GL4 may be arranged in the same manner as the pixels PX21 to PX28 connected to the second gate line GL2.

That is, the first pixel Pa and the second pixel Pb may be sequentially and repeatedly connected to odd-numbered gate lines among the gate lines GL1 to GLn along the first direction DR1. In detail, the red sub-pixel R, the green sub-pixel G, the blue sub-pixel B, and the white sub-pixel W may be sequentially and repeatedly arranged on the odd-numbered gate lines along the first direction DR1.

Furthermore, the second pixel Pb and the first pixel Pa may be sequentially and repeatedly connected to even-numbered gate lines among the gate lines GL1 to GLn along the first direction DR1. In detail, the blue sub-pixel B, the white sub-pixel W, the red sub-pixel R, the green sub-pixel G may be sequentially and repeatedly arranged on the even-numbered gate lines along the first direction DR1.

The first pixel Pa and the second Pixel Pb are sequentially and repeatedly arranged along a second direction DR2 along two columns of pixels.

A red color filter for transmitting red light may be formed on the red sub-pixel R. A green color filter for transmitting green light may be formed on the green sub-pixel G. A blue color filter for transmitting blue light may be formed on the blue sub-pixel B. However, a color filter is not formed on the white sub-pixel W. In this case, an organic/inorganic transparent layer for transmitting light with all wavelengths may be formed on the white sub-pixel W.

Figure 4:
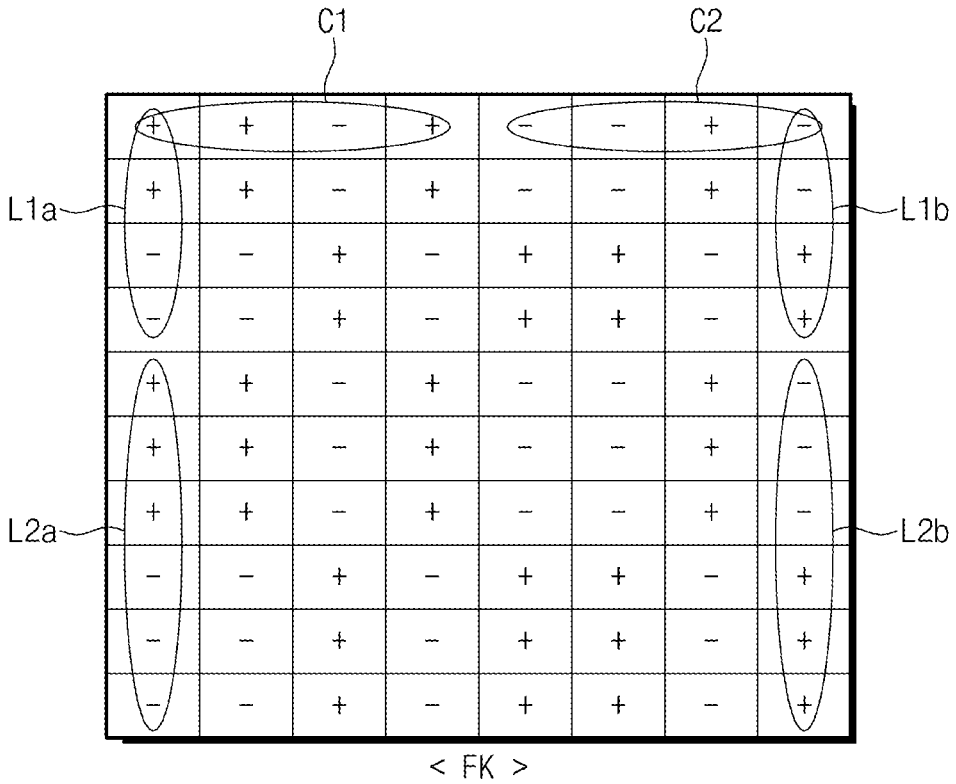

FIGS. 4 and 5 are diagrams illustrating the polarities of the data voltages provided to the display panel according to an embodiment of the inventive concept.

The polarities of the data voltages provided to the pixels illustrated in FIG. 3 will be described with reference to FIGS. 4 and 5. FIG. 4 illustrates the polarities of the data voltages based on a first frame Fk, and FIG. 5 illustrates the polarities of the data voltages based on a second frame Fk+1 following the first frame Fk.

Firstly, the polarities of the data voltages provided to the pixels PX11 to PX48 during the first frame Fk are described with reference to FIGS. 3 and 4.

According to an embodiment of the inventive concept, the polarity conversion unit 120 may output the inversion driving signal POL based on the quad inversion scheme to pixels connected to respective gate lines. In detail, the polarity conversion unit 120 determines the polarities of the data voltages to be applied to the pixels connected to respective gate lines on the basis of a line inversion scheme. The line inversion scheme may involve a first row polarity pattern C1 and a second row polarity pattern C2.

The polarity conversion unit 120 may output the inversion driving signal POL having a first pattern of positive polarity (+), positive polarity (+), negative polarity (−) and positive polarity (+) as the first row polarity pattern C1. For example, the first pixel PX11 connected to the first gate line GL1 receives a data voltage of positive polarity (+). The second pixel PX12 connected to the first gate line GL1 receives a data voltage of positive polarity (+). The third pixel PX13 connected to the first gate line GL1 receives a data voltage of negative polarity (−). The fourth pixel PX14 connected to the first gate line GL1 receives a data voltage of positive polarity (+).

The polarity conversion unit 120 may output the inversion driving signal POL having a second pattern of negative polarity (−), negative polarity (−), positive polarity (+) and negative polarity (−) as the second row polarity pattern C2. For example, the fifth pixel PX15 connected to the first gate line GL1 receives a data voltage of negative polarity (−). The sixth pixel PX16 connected to the first gate line GL1 receives a data voltage of negative polarity (−). The seventh pixel PX17 connected to the first gate line GL1 receives a data voltage of positive polarity (+). The eighth pixel PX18 connected to the first gate line GL1 receives a data voltage of negative polarity (−).

In this manner, the pixels connected to respective gate lines may receive the data voltages on the basis of the first and second polarity patterns C1 and C2.

Furthermore, according to an embodiment of the inventive concept, the polarity conversion unit 120 may output the inversion driving signal POL based on a first column inversion scheme and a second column inversion scheme to pixels connected to respective data lines. Here, the first column inversion scheme may be a 2-dot inversion scheme, and the second column inversion scheme may be a 3-dot inversion scheme. However, the inventive concept is not limited thereto, and the second column inversion scheme (L2) may be implemented with an n-dot inversion scheme, where n may be a natural number equal to or greater than 3.

In detail, the first column inversion scheme may involve a first column polarity pattern L1*a* and a second column polarity pattern L1*b*. The polarity conversion unit 120 may output the inversion driving signal POL having a first pattern of positive polarity (+), positive polarity (+), negative polarity (−) and negative polarity (−) as the first column polarity pattern L1*a*. The polarity conversion unit 120 may output the inversion driving signal POL having a second pattern of negative polarity (−), negative polarity (−), positive polarity (+) and positive polarity (+) as the second column polarity pattern L1*b*. That is, the polarity conversion unit 120 may output the inversion driving signal POL to each data line according to the 2-dot inversion scheme based on one of the first and second column polarity patterns L1*a* and L1*b*.

For example, the first pixel PX11 connected to the first data line DL1 receives a data voltage of positive polarity (+). The second pixel PX21 connected to the first data line DL1 receives a data voltage of positive polarity (+). The third pixel PX31 connected to the first data line DL1 receives a data voltage of negative polarity (−). The fourth pixel PX41 connected to the first data line DL1 receives a data voltage of negative polarity (−). In this case, the inversion driving signal POL based on the first column polarity pattern L1*a* may be output.

For example, the first pixel PX18 connected to the eighth data line DL8 receives a data voltage of negative polarity (−). The second pixel PX28 connected to the eighth data line DL8 receives a data voltage of negative polarity (−). The third pixel PX38 connected to the eighth data line DL8 receives a data voltage of positive polarity (+). The fourth pixel PX48 connected to the eighth data line DL8 receives a data voltage of positive polarity (+). In this case, the inversion driving signal POL based on the second column polarity pattern L1*b* may be output.

The second column inversion scheme may involve a third column polarity pattern L2*a* and a fourth column polarity pattern L2*b*. The polarity conversion unit 120 may output the inversion driving signal POL having a third pattern of positive polarity (+), positive polarity (+), positive polarity (+), negative polarity (−), negative polarity (−) and negative polarity (−) as the third column polarity pattern L2*a*. The polarity conversion unit 120 may output the inversion driving signal POL having a fourth pattern of negative polarity (−), negative polarity (−), negative polarity (−), positive polarity (+), positive polarity (+) and positive polarity (+) as the fourth column polarity pattern L2*b*. That is, the polarity conversion unit 120 may output the inversion driving signal POL to each data line according to the 3-dot inversion scheme based on one of the third and fourth column polarity patterns L2*a* and L2*b*.

Furthermore, according to an embodiment of the inventive concept, the polarity conversion unit 120 may output, to corresponding data lines among the data lines DL1 to DLm, the inversion driving signal POL of a polarity pattern in which the first column polarity pattern L1*a* and the third column polarity pattern L2*a* are sequentially repeated. According to an embodiment of the inventive concept, the polarity conversion unit 120 may output, to corresponding data lines among the data lines DL1 to DLm, the inversion driving signal POL of a polarity pattern in which the second column polarity pattern L1*b* and the fourth column polarity pattern L2*b* are sequentially repeated.

As described above, the polarity conversion unit 120 according to an embodiment of the inventive concept may output the inversion driving signal POL on the basis of a two dot inversion scheme or a three dot inversion scheme for each column.

In particular, since the polarity conversion unit 120 according to an embodiment of the inventive concept outputs the inversion driving signal POL on the basis of the first and second column inversion schemes, heat generated from the data driving unit 300 may be reduced. In general, as changes in the polarities of the data voltages provided to pixels of each column increase, the heat generated from the data driving unit 300 increases.

According to the present disclosure, the second column inversion scheme based on the 3-dot inversion scheme may cause a smaller polarity change than that caused by the first column inversion scheme based on the 2-dot inversion scheme. That is, the changes in the polarities of the data voltages may be smaller in the case where the polarity conversion unit 120 is operated on the basis of both the first and second column inversion schemes than in the case where the polarity conversion unit 120 is operated on the basis of the first column inversion scheme alone. As a result, the heat generated from the data driving unit 300 may be reduced.

FIG. 5 illustrates the polarities of the data voltages provided to the pixels PX11 to PX48 during the second frame Fk+1 following the first frame Fk. The polarities of the data voltages illustrated in FIG. 5 may be obtained by inverting the polarities of the data voltages of the first frame illustrated in FIG. 4. That is, the polarity conversion unit 120 may output, to a next frame, the inversion driving signal POL inverting the polarities of the data voltages of a previous frame.

According to an embodiment of the inventive concept, a display device may be operated on the basis of an inversion scheme in which polarities of data voltages repeat vertical 2 dots or vertical 3 dots. As a result, a crosstalk phenomenon and a flicker phenomenon may be avoided, and heat generated from a data driving unit may be reduced.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising:

a plurality of gate lines extending in a row direction;

a plurality of data lines intersecting with the gate lines, the data lines extending in a column direction;

a plurality of pixels connected to the gate lines and the data lines; and a data driving unit configured to output a plurality of data voltages to the pixels, wherein the pixels comprise first group pixels and second group pixels connected to one data line of the plurality of data lines, wherein the number of the first group pixels and the number of the second group pixels are different from each other, wherein the data driving unit outputs first data voltages to the first group pixels based on a first column inversion scheme and outputs second data voltages to the second group pixels based on a second column inversion scheme during a frame, and wherein the first column inversion scheme includes a first column polarity pattern and a second column polarity pattern which is an inverse pattern to the first polarity pattern, and the second column inversion scheme includes a third column polarity pattern and a fourth column polarity pattern which is an inverse pattern to the third polarity pattern.

2. The display device of claim 1, wherein the pixels comprise a plurality of first pixels and a plurality of second pixels, and wherein each of the first pixels comprises a red sub-pixel and a green sub-pixel and each of the second pixels comprises a blue sub-pixel and a white sub-pixel.

3. The display device of claim 2, wherein the first pixels and the second pixels are alternatingly arranged along the row direction, and wherein the first pixels and the second pixels are alternatingly arranged in two columns along the column direction.

4. The display device of claim 1, wherein pixels connected to a same gate line have a quad inversion scheme which inverts polarities of pixels every four pixels.

5. The display device of claim 4, wherein the quad inversion scheme has a first polarity pattern during a predetermined frame and a second polarity pattern during a frame next to the predetermined frame, the first polarity pattern having polarities of (+), (+), (−) and (+), the second polarity pattern being an inverse pattern to the first polarity pattern.

6. The display device of claim 1, wherein the first column inversion scheme is implemented with a k-dot inversion scheme, and the second column inversion scheme is implemented with an r-dot inversion scheme, wherein k and r are natural numbers, and wherein k is greater than r.

7. The display device of claim 6, wherein r is greater than 2.

8. The display device of claim 1, further comprising a polarity conversion unit configured to output an inversion driving signal for controlling polarities of the data voltages.

9. The display device of claim 8, wherein the data driving unit outputs the data voltages in response to the inversion driving signal.

10. The display device of claim 8, wherein the polarity conversion unit outputs the inversion driving signal corresponding to each of a plurality of frames.

11. The display device of claim 10, wherein the plurality of frames comprise a first frame and a second frame following the first frame, wherein the polarity conversion unit outputs, to the second frame, the inversion driving signal comprising the polarities of the data voltages which are inverted compared to the polarities of the data voltages of the first frame.

12. The display device of claim 1, wherein the first column polarity pattern has polarities of (+), (+), (−) and (−), and the second column polarity pattern is an inverse pattern to the first column polarity pattern.

13. The display device of claim 12, wherein the third column polarity pattern has polarities of (+), (+), (+), (−), (−) and (−), and the fourth column polarity pattern is an inverse pattern to the third column polarity pattern.

14. The display device of claim 13, wherein the data voltages having one of a first pattern in which the first column polarity pattern and the third column polarity pattern are repeated and a second pattern in which the second column polarity pattern and the fourth column polarity pattern are repeated are output to the data lines along the column direction.

* * * * *